US005201664A

United States Patent [19]

Korsunsky et al.

[11] Patent Number: 5,201,664

[45] Date of Patent: Apr. 13, 1993

[54] ALIGNMENT MEMBER FOR USE WITH SURFACE MOUNT CONTACTS

[75] Inventors: Iosif Korsunsky, Harrisburg; Dimitry G. Grabbe, Middletown, both of Pa.

[73] Assignee: AMP Incorporated, Harrisburg, Pa.

[21] Appl. No.: 834,460

[22] Filed: Feb. 12, 1992

[51] Int. Cl.[5] ..... H01R 23/72

[52] U.S. Cl. ..... 439/83; 439/892

[58] Field of Search ..... 439/79, 80, 83, 874, 439/876, 892, 893

[56] References Cited

U.S. PATENT DOCUMENTS

| | | | |
|---|---|---|---|
| 2,997,531 | 8/1961 | Oldham | 174/72 A |
| 4,734,042 | 3/1988 | Martens | 439/62 |
| 4,917,614 | 4/1990 | Kikuchi | 439/83 |
| 4,952,529 | 8/1990 | Grider | 439/437 |
| 5,051,813 | 9/1991 | Schneider | 357/72 |
| 5,127,829 | 7/1992 | Korsunsky et al. | 439/79 |

OTHER PUBLICATIONS

AMP Circular; "Communication and Teledensity Connectors", 1988.

*Primary Examiner*—Neil Abrams

*Attorney, Agent, or Firm*—Bruce J. Wolstoncroft

[57] ABSTRACT

An electrical connector for surface mounting to a printed circuit board has circuit board mating legs of terminals which extend from a housing of the connector. An alignment member cooperates with the mating legs of the terminals to maintain the mating legs in position relative to each other and relative to the housing, thereby facilitating the close center-line spacing of the terminals.

19 Claims, 3 Drawing Sheets

ALIGNMENT MEMBER FOR USE WITH SURFACE MOUNT CONTACTS

FIELD OF THE INVENTION

The invention is directed to an alignment member which cooperates with contacts of a connector to maintain the contacts in the proper position, thereby ensuring that each contact will establish a positive electrical connection with respective contact areas of a substrate when the connector is mated with the substrate.

BACKGROUND OF THE INVENTION

There are currently numerous electrical connectors available which are mounted to a printed circuit board. As the size of the machines in which the printed circuit boards are installed decreases, the density of the connectors positioned on the board must increase. Also, as the machines become more sophisticated, the complexity of the printed circuit boards and the connectors must increase. Consequently, the configuration of the machines requires that electrical connectors with numerous terminals extending therefrom be mounted on a printed circuit board in such a manner so as to occupy a minimal area of board real estate.

In order for the connectors to occupy a minimal amount of board real estate, it has become extremely desirable for connectors to have closely spaced terminals. To accomplish the required spacing, all dimensions of the connector must be minimized. However, the performance of the connector cannot be compromised due to the close centerline spacing of the terminals. It is therefore essential that the electrical characteristics of the connector not diminish as the size of the connector is reduced.

As the size of the terminals and the spacing therebetween is reduced, it is essential that the spacing and position of the terminals by adequately controlled. This is particularly true with the mounting portions of the terminals. If the spacing is not controlled, thereby allowing the terminals to be damaged or bent during transportation, installation, etc., the entire may be rendered effectively useless, as the terminals of the connector will not properly align with the mating pads of the circuit board.

In order to ensure that the terminal are maintained in proper position relative to each other, it would be beneficial to provide an alignment member which cooperates with the mounting portions of the terminal to maintain the mounting portions in proper position.

SUMMARY OF THE INVENTION

The invention is directed to an electrical connector which mounts on a printed circuit board. The electrical connector has a housing with terminal receiving cavities with terminals positioned therein. The terminals have circuit board mounting portions which extend from the connector housing. The circuit board mounting portions of the terminals are configured to cooperate with contact pads provided on the surface of the printed circuit board.

A terminal positioning or alignment member cooperates with the circuit board mounting portions of the terminals to ensure that the circuit board mounting portions are maintained in proper position relative to the connector housing, so that as the electrical connector is mated to the printed circuit board, the circuit board mounting portions will be positioned in alignment with the contact pads of the printed circuit board.

DETAILED DESCRIPTION OF THE INVENTION

Figure 1:
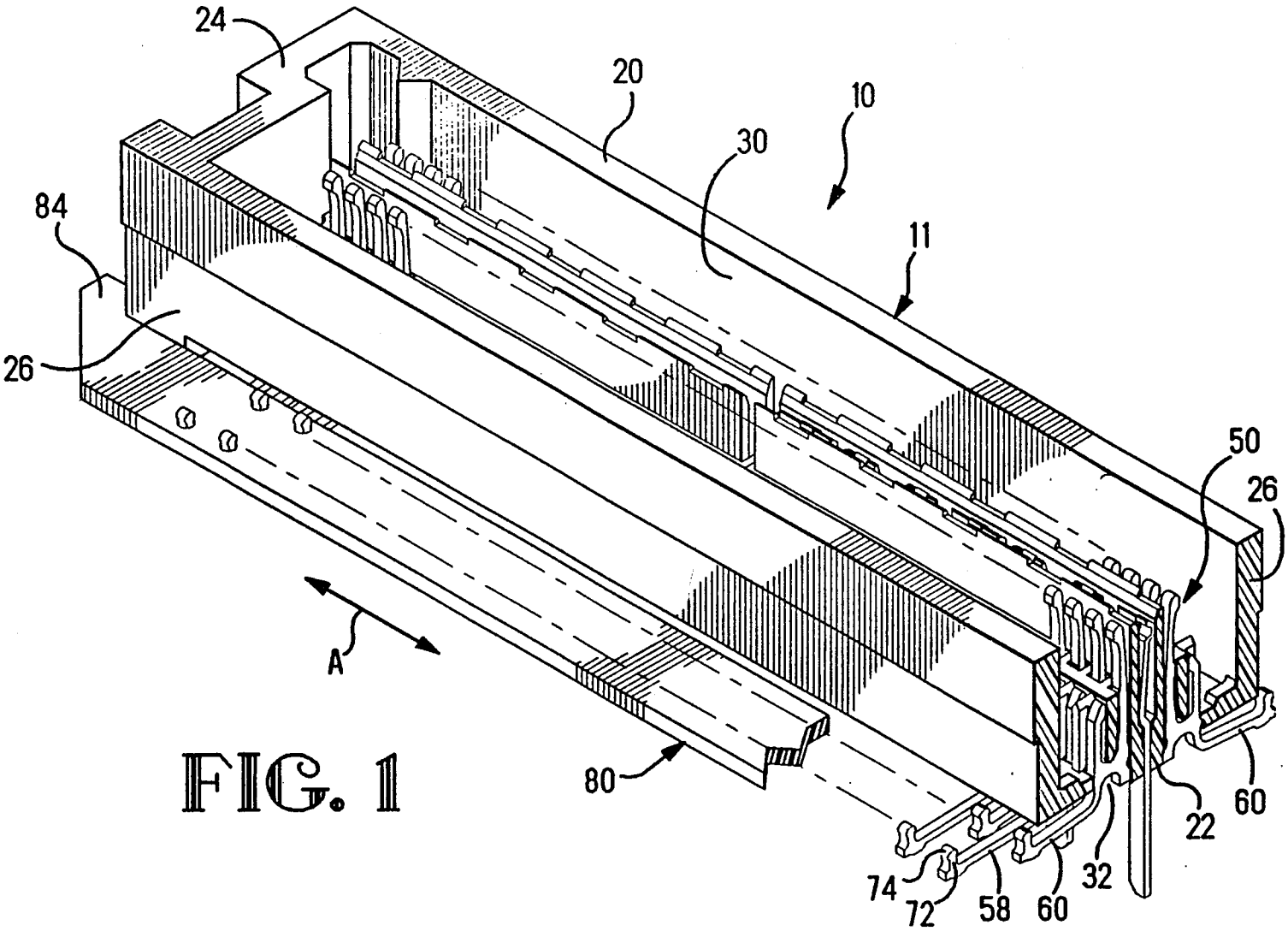
FIG. 1 is a three dimensional cross-sectional view of a connector housing having a terminal positioning member provided on terminals thereof.

Referring to FIG. 1, an electrical connector 10, which provides the electrical connection between a printed circuit board 12 (FIG. 2) and a mating connector (not shown), has a housing 11 with a first or connector mating surface 20 and an oppositely facing second or circuit board mating surface 22. End walls 24 and side walls 26 extend between the connector mating surface 20 and the circuit board mating surface 22.

A mating connector receiving recess 30 extends from the connector mating surface 20 toward the circuit board mating surface 22. The mating connector receiving recess 30 is dimensioned to be positioned proximate the end walls 24 and proximate the side walls 26.

Terminal receiving cavities 32 extend from the circuit board mating surface 22 to the mating connector receiving recess 30. The terminal receiving cavities 32 are provided on both sides of the longitudinal axis of the housing 11 of the connector 10. The terminal receiving cavities 32 provided on a respective side of the axis are mirror images of the terminal receiving cavities provided on the opposite side of the axis.

Figure 2:
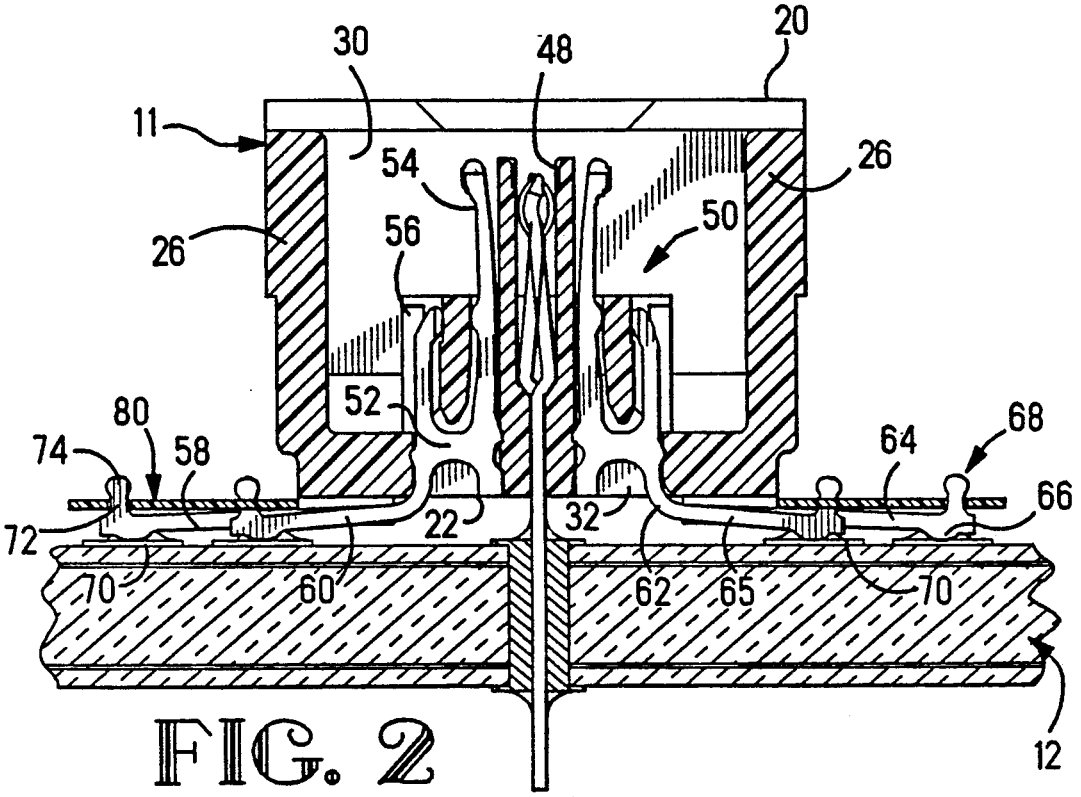
FIG. 2 is a cross-sectional view of the connector housing of FIG. 1 mated to a printed circuit board.

Bus bar receiving recess 48, as best shown in FIG. 2, is provided in the connector 10. The bus bar receiving recess 48 extends from the mating connector receiving recess 30 to proximate the circuit board mating surface 22. A bus bar, which is described in copending U.S. application, Ser. No. 07/741,717, filed Aug. 6, 1991, is provided in the recess 48.

Terminals 50, as best shown in FIG. 2, have mounting portions 52. First legs 54 and second legs 56 extend from the mounting portions 52 into the mating connector receiving recess 30, thereby enabling the first and the second legs 54, 56 to be mated with the mating connector, as is more fully discussed in copending U.S. application, Ser. No. 07/692,085, filed Apr. 26, 1991, which is incorporated herein by reference.

Printed circuit board mating legs 58, 60 extend from the mounting portions 52 beyond the circuit board mating surface 22. Each circuit board mating leg 58 has an arcuate section 62, an intermediate section 64, a mating section 66 and an alignment or positioning section 68. Each circuit board mating leg 60 has identical sections, with the exception that intermediate section 65 of circuit board mating leg 60 is shorter in length than intermediate portion 64 of circuit board mating leg 58. This configuration allows the mating sections and alignment sections to be staggered, as best shown in FIG. 1. The staggered pattern of the mating sections is one characteristic which permits the terminals to have close center-line spacing. The staggered spacing is also required due to the staggered configuration of the pads 70 on the circuit board. This configuration of the pads minimizes the possibility of shorting therebetween.

The intermediate sections 64, 65 extend from the housing in a direction which is essentially parallel to the circuit board mating surface 22. As viewed in FIG. 2, the intermediate sections 64, 65 have first edge surfaces and second edge surfaces. The mating sections 66 are provided on the first edge surfaces and the alignment sections 68 are provided on the second edge surfaces.

Figure 5:
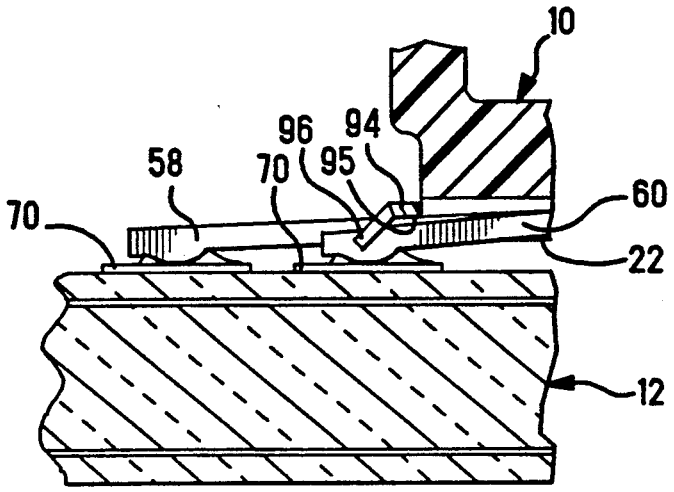
FIG. 5 is a partial cross-sectional view of the connector housing mated to the printed circuit board with a second alternate terminal positioning member provided thereon.

As is shown in FIGS. 2 and 5, the mating sections 66 are positioned in electrical engagement with conductive pads 70 positioned on the surface of printed circuit board 12. The mating sections 66 are soldered to the pads 70 to provide a stable and reliable electrical connection and to provide the mounting required to hold the connector in position relative to the board. In order for a positive electrical connection to be effected, it is essential for the mating sections to be properly aligned with the pads of the board. This is particularly important in application in which the terminals and pads are closely spaced.

Referring to FIGS. 1 and 2, alignment sections 68 extend from printed circuit board mating legs in a direction away from the printed circuit board. The alignment sections 68 are positioned proximate mating sections 66. Each alignment section 68 has a narrow neck section 72 and an enlarged retention section 74. The neck section 72 is integrally attached to the board mating legs of the terminals 50.

Figure 3:
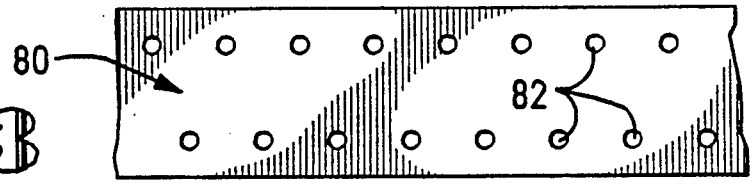
FIG. 3 is a top plan view of a section of the terminal positioning member shown in FIG. 1.

A terminal positioning or alignment member 80, as shown in FIG. 3, is made of mylar, Ryton, water soluble paper, or other material which allows for the resilient deformation of the alignment member when the alignment member is inserted onto the terminals, while providing relatively rigid properties when the material is stretched in the plane of the material. In many instances, the alignment member must be manufactured from a material which is sufficiently transparent to an inferred energy source. This allows the inferred energy to pass through the alignment member and act on the solder, thereby enabling the terminals to be effectively connected to the board.

Alignment member 80 has a plurality of openings 82 which extend therethrough. The openings 82 are configured to correspond to the configuration of the alignment sections 68 of the terminals 50. Therefore, in the particular embodiment shown in FIG. 3, the openings 82 are staggered in the same manner as alignment sections 68. Each alignment member 80 has a respective opening for each alignment section positioned on a respective side of the connector 10.

Each aperture or opening 82 has a circular configuration, the diameter of which is slightly larger than the diameter of the neck section 72. Although the openings shown in FIG. 3 are circular, it is conceived that the openings can be of various shapes, including polygon.

To position the alignment members on terminals, the alignment members 80 are placed over the alignment sections 68, such that the openings 82 are aligned with the retention sections 64. This may be done prior to or after the terminals have been positioned in the connector. The alignment members are then forced into engagement with the alignment sections. As this occurs, the openings 82, which are smaller in size than the retention sections 74, will be elastically deformed and moved over the retention sections. The material of the alignment member is such that after the openings 82 have been moved past the retention sections 74, the openings will return to a shape which approximates their original shape. After the alignment member has been moved past the retention sections, the openings 82 cooperate with the neck sections 72. In this fully inserted position, the alignment member cooperates with the alignment sections 68 to prevent movement of the alignment sections relative to each other.

It is important to note that the openings 82 are only slightly larger than the neck sections 72. Therefore, as the dimensions of the openings and neck sections are essentially the same, the cooperation of the alignment member with the neck portions allows the alignment member and neck portions to behave as a single member. In other words, if a force is applied in a direction indicated by arrow A of FIG. 1 to one mating leg 58, the force is transferred through the alignment member to all the mating legs, thereby making it difficult to permanently deform a single mating leg. It is consequently important that the alignment member have sufficient tensile strength to withstand such forces encountered during shipping and handling of the connector.

The alignment member 80 is maintained in position on the mating legs by the interference fit described above. Therefore, if a respective terminal must be inspected or repaired, the alignment member may be removed in order to facilitate the operation. As the alignment member 80 may be retained in position on the mating legs, it is important to note that the enlarged retention sections 74 of the alignment sections 68 extend above the alignment member. This configuration allows the enlarged retention sections 74 to be used as test points, thereby eliminating the need to remove the alignment member in order to inspect the terminals 50.

In order to provide enhanced stability of the terminals and alignment members relative to the connector 10, the alignment members cooperate with the end walls 24 of the connector. As shown in FIG. 1, securing projections 84 of alignment member 80 extend from the main portion of the alignment member in a direction toward connector 10. The securing projections are spaced apart by a distance which is slightly greater than the length of the connector. This allows the securing projections to be positioned adjacent to the end walls of the connector when the alignment member is inserted onto the alignment sections 68 The cooperation of the alignment member with the end walls of the connector provides increased stability to the mating legs of the terminals. As the alignment member is fixed to the connector, a force applied to the mating legs in the direction of arrow A will be transferred to the connector. As the connector housing is relatively rigid, the force applied to the terminal will be absorbed by the housing, thereby preventing damage to the terminal. Consequently, the mating sections of the terminals will be maintained in proper position relative to the connector 10.

Figure 4:
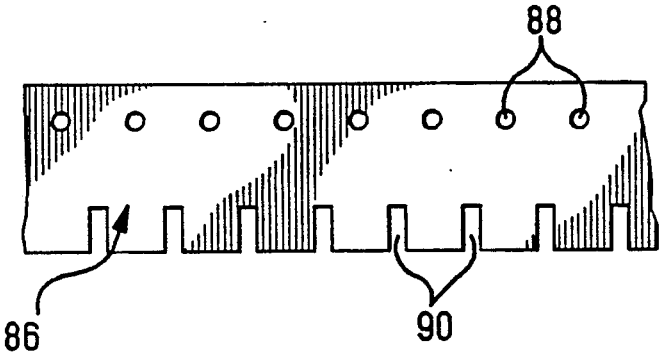
FIG. 4 is a top plan view of a section of a first alternate terminal positioning member.

FIG. 4 illustrates an alternate embodiment of the alignment member. Alignment member 86 has openings 88 and slots 90 provided thereon. The opening 88 cooperate with the mating legs 60, as previously discussed. The slots 90 cooperate with the alignment sections 68 of mating legs 58 in a similar manner to the openings. Slots 90 cooperate with neck sections 72. The slots are dimensioned to receive the neck section therein. However, the width of the slots 90 is only slightly larger than the width of the neck portions 72. Consequently, the alignment member will cooperate with mating legs 58 to prevent the movement of the legs in the direction of arrow A of FIG. 1.

Figure 6:
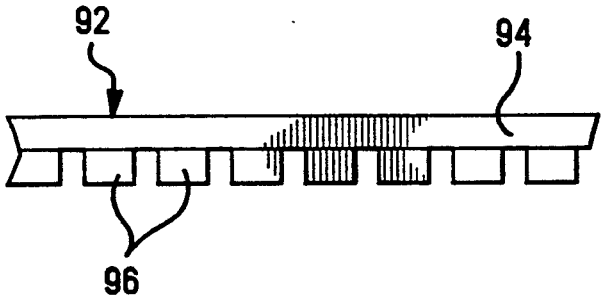
FIG. 6 is a top plan view of a section of the second alternate terminal positioning member.

FIGS. 5 and 6 show a second alternate embodiment of the alignment member. Alignment member 92 has a continuous section 94 with separating arms 96 extending therefrom. As best shown in FIG. 5, the continuous section 94 is positioned on mating arms 58, 60 and secured thereto. One manner to secure the continuous section to the mating arms is by means of an adhesive strip as indicated by 95 in FIG. 5 or the like. The separating arms 96 are bent to extend downward (as viewed in FIG. 5) between the mating arms 58, 60. The separating arms are dimensioned to extend between the mating arms to maintain the spacing therebetween. With the separating arms positioned between the mating legs of the terminals, it becomes more difficult to deform the individual terminals. Although this embodiment does not have openings and slots as described above, the operation of the alignment member 92 is similar to that described above.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

We claim:

1. An electrical connector for mounting on a printed circuit board has a housing with terminal receiving cavities provided therein, the terminal receiving cavities have terminals positioned therein, the terminals have circuit board mating portions which extend from a circuit board mating surface of the connector housing, the circuit board mating portions of the terminals are configured to cooperate with contact pads provided on the surface of the printed circuit board for surface mounting thereto, the electrical connector comprising:

a terminal positioning member which cooperates with the circuit board mating portions of the terminals to ensure that the circuit board mating portions of the terminals are maintained in proper position relative to the connector housing, the circuit board mating portions have positioning sections which cooperate with the terminal positioning member, whereby as the electrical connector is positioned adjacent the printed circuit board the terminal positioning member cooperates with the positioning sections of the circuit board mating portions to ensure that the circuit board mating portions are positioned in alignment with the contact pads of the printed circuit board.

2. An electrical connector as recited in claim 1 wherein the terminal positioning member is a strip of material which maintains the spacing of the circuit board mating portions.

3. An electrical connector as recited in claim 2 wherein the circuit board mating portions of the terminals extend in a direction which is essentially parallel to the circuit board mating surface of the connector, the circuit board mating portions have first edge surfaces which cooperate with the printed circuit board and an oppositely facing second edge surfaces, the terminal positioning member cooperates with the second edge surfaces to maintain the circuit board mating portions is proper position.

4. An electrical connector as recited in claim 3 wherein the positioning sections extend from the second edge surface in a direction which is essentially perpendicular to the axis of the circuit board mating portions.

5. An electrical connector as recited in claim 4 wherein the positioning sections have enlarged retention sections, the enlarged retention sections maintain the terminal positioning member in position relative to the circuit board mating portions.

6. An electrical connector as recited in claim 4 wherein the terminal positioning member has openings which extend therethrough, the openings are dimensioned to receive the positioning sections therein.

7. An electrical connector as recited in claim 4 wherein the terminal positioning member has slots which extend therethrough, the slots are dimensioned to receive the positioning sections therein.

8. An electrical connector as recited in claim 3 wherein the terminal positioning member has separating arms which extend from a continuous section of the positioning member in a direction toward the first edge surfaces of the terminals, the separating arms are positioned between the circuit board mating portions and cooperate with the circuit board mating portions to maintain the spacing therebetween.

9. An electrical connector as recited in claim 8 wherein the continuous section of the terminal positioning member is adhered to the second edge surface of the circuit board mating portions to maintain the terminal positioning member in position relative to the terminals.

10. An electrical connector as recited in claim 3 wherein the terminal positioning member has securing projections provided thereon, the securing projections cooperate with the connector housing to prevent the movement of the terminal positioning member in a direction parallel to the longitudinal axis of the housing.

11. An electrical connector as recited in claim 6 wherein the openings are dimensioned to provide an interference fit with the positioning sections of the terminals, whereby the terminal positioning member is removable from the positioning sections of the terminals.

12. An electrical connector as recited in claim 11 wherein the openings have a circular configuration.

13. An electrical connector as recited in claim 11 wherein the openings have a polygon configuration.

14. An electrical connector for surface mounting to circuit pads of a printed circuit board has a housing with terminals provided therein, the terminals have circuit board mating legs which extend from the housing, the circuit board mating legs have mating sections which are positioned to cooperate with the printed circuit board, the electrical connector comprising:

a terminal alignment member which cooperates with the circuit board mating legs, the terminal alignment member engages the circuit board mating legs proximate the mating sections, the circuit board mating legs have first edge surfaces which have the mating sections provided thereon, and oppositely facing second edge surfaces which have positioning sections extending therefrom, the terminal alignment member cooperates with the positioning sections, whereby the mating sections of the circuit board mating legs are maintained in a position which ensures that the mating legs will be placed in electrical engagement with the pads of the printed circuit board as the connector is mated to the circuit board.

15. An electrical connector as recited in claim 14 wherein the terminal alignment member has openings which extend therethrough, the openings are dimensioned to receive the positioning section therein.

16. An electrical connector as recited in claim 15 wherein the positioning sections have enlarged retention sections and neck sections, the openings of the terminal alignment member cooperate with the neck portions to maintain the circuit board mating legs in position, the enlarged retention sections are integral with the neck portions, the enlarged retention sections cooperate with the openings of the terminal alignment member to retain the terminal alignment member in position on the neck sections.

17. An electrical connector as recited in claim 14 wherein the terminal alignment member has separating arms which extend from a continuous section of the positioning member in a direction toward the first edge surfaces of the terminals, the separating arms are positioned between the circuit board mating legs and cooperate with the circuit board mating legs to maintain the spacing therebetween.

18.. An electrical connector as recited in claim 14 wherein the terminal alignment member has securing projections provided thereon, the securing projections cooperate with the housing of the electrical connector to prevent the movement of the terminal alignment member in a direction parallel to the longitudinal axis of the housing.

19. An electrical connector for mounting to circuit pads of a printed circuit board, the electrical connector comprising:

a housing having a connector mating surface and a circuit board mating surface;

terminals provided in the housing, the terminals having connector mating portions and circuit board mating legs, the circuit board mating legs extend from the housing beyond the circuit board mating surface in a direction which is essentially parallel to the plane of the circuit board mating surface, the mating legs have first edge surfaces and oppositely facing second edge surfaces, circuit board mating sections are provided on the first edge surfaces and terminal positioning sections extend from the second edge surfaces;

at least, one terminal alignment member cooperates with said terminal positioning sections of respective terminals to maintain the position of the respective terminals in position relative to each other.

* * * * *